United States Patent [19]

Ariga et al.

[11] 4,250,645

[45] Feb. 17, 1981

[54] INDICATING DEVICE WITH FLAT FLUORESCENT LAMP

[75] Inventors: Kazuo Ariga, Tokyo; Norimasa Oinuma, Machida; Youichiro Akanuma; Mitunari Yoshida, both of Tokyo, all of Japan

[73] Assignee: Stanley Electric Co., Ltd., Tokyo, Japan

[21] Appl. No.: 39,318

[22] Filed: May 16, 1979

Related U.S. Application Data

[63] Continuation-in-part of Ser. No. 876,315, Feb. 9, 1978, abandoned.

[51] Int. Cl.[3] ..... G09F 13/26

[52] U.S. Cl. ..... 40/545

[58] Field of Search ..... 40/545, 544, 152.2, 40/564; 313/493, 152.2

[56] References Cited

U.S. PATENT DOCUMENTS

| | | | |
|---|---|---|---|
| 2,482,421 | 9/1949 | Lemmers | 313/493 |
| 3,083,317 | 3/1963 | Fish et al. | 40/544 |
| 3,161,974 | 12/1964 | Blockson | 40/544 |
| 3,258,630 | 6/1966 | Scott | 313/493 |

FOREIGN PATENT DOCUMENTS

| | | | |
|---|---|---|---|
| 417362 | 11/1910 | France | 40/553 |

*Primary Examiner*—Gene Mancene
*Assistant Examiner*—Wenceslao J. Contrera
*Attorney, Agent, or Firm*—Frishauf, Holtz, Goodman & Woodward

[57] ABSTRACT

An indicating device with a flat fluorescent lamp which comprises a fluorescent lamp having flat side surfaces and one or more indications formed on the side surfaces of the fluorescent lamp. The indicating device can be further provided with an ornamental frame which is attached to the outer periphery of the fluorescent lamp and a mounting base which is attached to one side of the ornamental frame and holds therein a discharge circuit including a stabilizer and a glow lamp for the fluorescent lamp.

5 Claims, 12 Drawing Figures

INDICATING DEVICE WITH FLAT FLUORESCENT LAMP

CROSS-REFERENCE TO RELATED APPLICATION

This application is a continuation-in-part of copending application Ser. No. 876,315 filed on Feb. 9, 1978 now abandoned.

BACKGROUND OF THE INVENTION

The present invention relates to an indicating device with a flat fluorescent lamp which is suitable for indicating "operation", "stop" or the like of various kinds of instruments, indicating a room number or a room name in inns and hotels, indicating "emergency exit", "all-night light" or the like, and indicating the desired matters in conveyances.

DESCRIPTION OF THE PRIOR ART

An indicating device generally used in the prior art is constituted by mounting a plate-like indicating body on a desired place by means of a mounting member. The indicating body is illuminated by an external source without having its own illuminating means. Such an indicating device has a defect in that the indication is difficult to be seen in a place of weak illumination, at night or the like.

An indicating device is also known, in which a luminous body, such as a fluorescent lamp or an electric lamp is disposed in a casing and one or both side surfaces of the casing are used as indicating portions including light-transmissive portions and non-light-transmissive portions. In such an indicating device, since a light source and an indicating portion are separated from each other, the device is large in size, takes much time in its assembling and mounting, and is high in price. Further, in this case, if an ordinary fluorescent lamp is used as a light source, since the device must self contain a discharge circuit including a stabilizer, a glow lamp or the like, the device becomes heavier in its weight and as a result of this, a defect occurs whereby a mounting member is liable to be separated from the wall face.

OBJECT OF THE INVENTION

In view of the above defects in the conventional devices, it is an object of the invention to provide an indicating device which directly uses a side surface of a fluorescent lamp as an indicating surface.

It is another object of the invention to provide an indicating device with a flat fluorescent lamp having a mounting base which is constituted integrally with an indicating portion and is serviceable to mount the device on a wall face and self-contains a discharge circuit including a stabilizer and a glow lamp.

The above and other objects and features of the invention will be understood more fully hereinafter from the consideration on the following description taken in connection with the accompanying drawings.

DESCRIPTION OF PREFERRED EMBODIMENTS OF THE INVENTION

Figure 1:
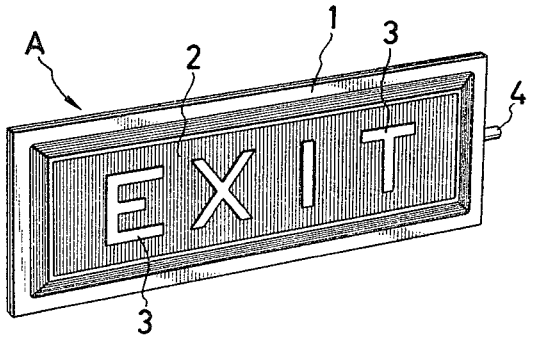
FIG. 1 is a perspective view showing an embodiment of an indicating device according to the present invention.
Figure 2:
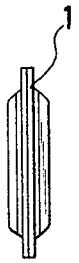
FIG. 2 is a side view of the indicating device shown in FIG. 1.
Figure 3:
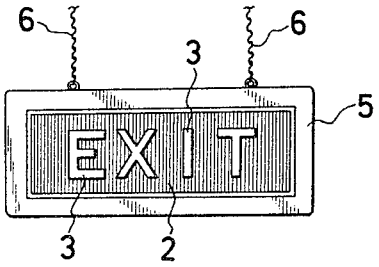
FIG. 3 is an elevational view of an indicating device similar to that shown in FIG. 1 having an ornamental frame and hanging means.
Figure 4:
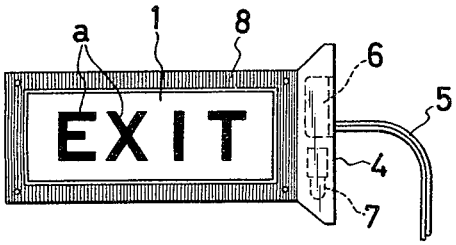
FIG. 4 is an elevational view showing another embodiment of an indicating device according to the invention.
Figure 5:
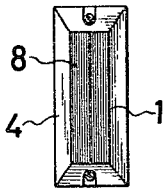
FIG. 5 is a side view of the indicating device shown in FIG. 4.
Figure 6:
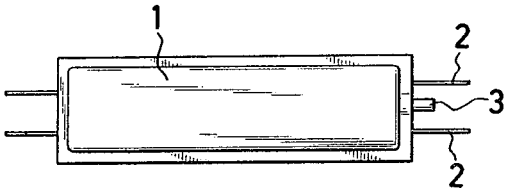
FIG. 6 is an elevational view of a flat fluorescent lamp used in the indicating device of the invention.
Figure 7:
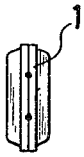
FIG. 7 is a side view of the fluorescent lamp shown in FIG. 6.

Referring to FIGS. 1 to 3, there is shown in indicating device A which is composed of a body of a flat fluorescent lamp 1. One or both flat surfaces on the sides of the body 1 are divided into portions 3 for showing desired indicating configurations, such as letters, patterns, figures or the like and the other non-light-transmissive portions 2 that are made by printing or by applying non-light-transmissive materials. This division may be made by sticking the non-light-transmissive material such as a colored film, paper or the like that is cut out only at the portion 3 for indicating letter, pattern, figure or the like, on the body of flat fluorescent lamp. The portion 3 is adapted to transmit light.

The color of transmitted light may be optionally selected. That is, the object may be attained by applying a transparent colored paint on the portion 3 for indicating letter, pattern, figure or the like or by sticking a transparent colored film thereon. Also the luminous light of the fluorescent lamp itself may be colored by selecting the fluorescent material of the lamp.

The indicating portion 3 may be formed by disposing a letter, pattern, figure or the like of a non-light-transmissive material directly on the flat side surface of the fluorescent lamp 1.

As will be understood from the above description, it can be attained that the indicating device with the flat fluorescent lamp has various esthetic effects and colorful effects, by the combination of the indicating portion 3 as a light-transmissive portion and the other ground portion as a non-light-transmissive portion, by the combination of the indicating portion 3 as a non-light-transmissive portion and the other ground portion as a light-transmissive portion, or by the combination of the portions of various colors.

Reference numeral 4 denotes an exhaust pipe which is used for making vacuum the inside of the flat fluorescent lamp 1 and for charging a gas thereinto. Reference numeral 5 indicates an ornamental frame which surrounds the flat fluorescent lamp 1 and is mounted on the periphery of the lamp so as to make the appearance good. Reference numeral 6 denotes a means for hanging the device from a ceiling or the like.

In the embodiment mentioned above, since the device can use as a light source a small sized flat fluorescent lamp and use directly as an indicating surface a flat side surface of the light source, it can be made very compact in size and simple and easy in its mounting. In addition, the device has significant effects in that a small-sized indication having an excellent esthetic worth and a colorful effect can be made and further that the luminous intensity of the indication is uniform.

Referring to FIGS. 4 to 10, there is shown an indicating device according to the invention adapted to use by mounting on a wall. The indicating device is mounted on a desired wall face by means of a mounting base 4 and can be connected to a power source by means of a power cord 5. Self-contained in the mounting base 4 is a discharge circuit including a stabilizer 6 and a glow lamp 7. Reference numeral 8 denotes an ornamental frame which surrounds the outer periphery of the flat fluorescent lamp 1 and which is adapted to protect the fluorescent lamp 1 and to cover the wiring 9 in the fluorescent lamp 1, thereby making the appearance good.

Figure 8:
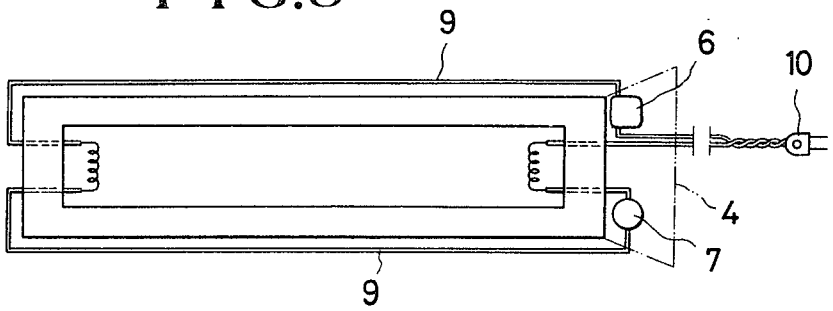
FIG. 8 is a schematic illustration of the wiring of flat fluorescent lamp used for the embodiment of FIG. 4.
Figure 9:
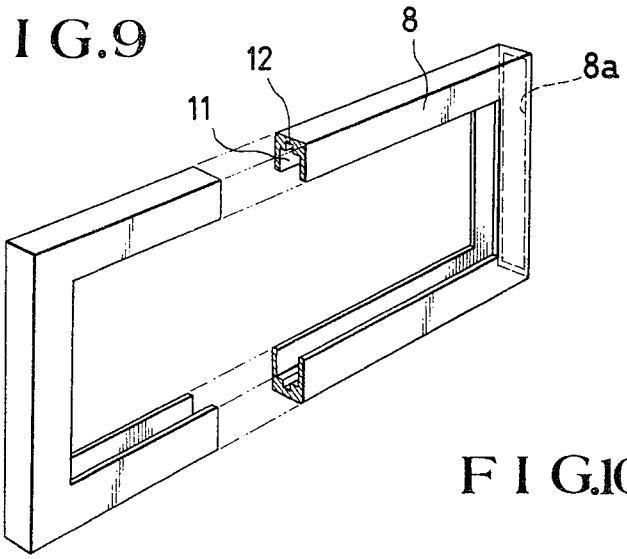
FIG. 9 is a perspective view of the ornamental frame of the same embodiment.
Figure 10:
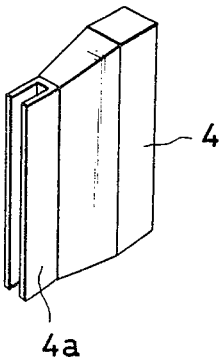
FIG. 10 is a perspective view of the mounting base of the same embodiment.

The wires 9 of the lamp 1 are disposed along the outer periphery of the lamp 1 and, by way of the stabilizer 6 and the glow lamp 7, the free ends of the wires 9 are connected to a plug 10, as shown in FIG. 8. This assembly is covered by an ornamental frame 8 which is shown in FIG. 9. The ornamental frame 8 is provided with a lamp groove 11 and a wire groove 12. The wires 9 extending along the side edges of the lamp 1 are received within the wire groove 12 and the side edge portions of the lamp 1 are received within the lamp groove 11 in the assembling work. Thus, the mounting base 4 is provided with a pair of lip members **4*a* which are inserted into and attached to the open end 8*a* of the frame 8 and the lip members 4*a* hold therebetween the right side (in the drawings) edge of the lamp 1**.

As described above, the indicating device according to the invention is able to have a self-illumination and indications on both sides thereof. Further, the device is thin in its configuration and has a mounting base formed integrally with the indicating portion so as to mount the device on a wall face. Accordingly, with the device of the invention, the indication can be made very clear at a place where it is difficult to see, such as a corridor, and the colorful indications may be attained by optionally coloring the indication "a". Further, the device is simple to be mounted on the wall face and is economical and convenient in use, for example, since in the device for a meeting room, the lamp may be turned on when using the room and the lamp may be turned off when it is not being used.

Furthermore, with the invention since the device is mounted on the wall face with the mounting base 4 holding therein a discharge circuit including a stabilizer, a glow lamp or the like, the indication is not obstructed by them and can be made small in configuration. In addition, the device is easily mounted and handled since the cord 5 extends out from the device itself.

Figure 11:
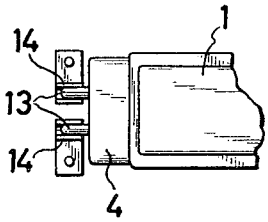
FIG. 11 is a partly cutout elevational view showing another embodiment of an indicating device of the invention.
Figure 12:
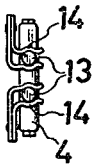
FIG. 12 is a side view of the fluorescent lamp shown in FIG. 11.

In the invention, since the life time of the lamp is long, it is not disadvantageous to interchange the whole device when the lamp is off. However, as shown in FIGS. 11 and 12, a socket system may be used in the indicating device according to the invention. The interchange of the fluorescent lamp may be easily performed only by removing the ornamental frame 8 from the fluorescent lamp 1. In this case, plugs 13 provided on the outer end of the mounting base 4 are inserted into sockets 14 that are fixed on the wall side.

In the invention, the indication in the indicating portion may be made on both sides of the flat fluorescent lamp by directly printing or drawing the indication such as letter, figure or the like, or by sticking patterns that are formed of film, paper or the like on the side of the lamp. Various, complicated and beautiful color effects are obtained by combining the color of patterns and the color of the fluorescent lamp.

While the invention has shown and described certain present preferred embodiments, it is to be understood that the invention is not limited thereto but may be variously embodied within the scope of the appended claims.

What is claimed is:

1. A fluorescent lamp type indicating device comprising:

a flat type fluorescent lamp having opposing flat side surfaces and outer peripheral edges, and at least one indication means formed on a side surface of said fluorescent lamp, said indication means comprising at least one indicating portion and a ground portion which occupies the area of said side surface other than said indicating portion, the colors or light transmittance of said indicating portion being different from that of said ground portion, an ornamental frame surrounding and attached to said outer peripheral edges of said fluorescent lamp, said ornamental frame having a lamp receiving groove therein to receive in said groove said outer peripheral edges of said fluorescent lamp, and a wire receiving groove therein to receive in said wire receiving groove electrical wires running to said fluorescent lamp for energizing said fluorescent lamp, and a mounting base attached to one side of said ornamental frame and containing therein a discharge circuit for said fluorescent lamp including a stabilizer and a glow lamp, said discharge circuit being connected to said electrical wires which are received in said wire receiving groove of said frame.

2. The indicating device as claimed in claim 1, wherein said ornamental frame has an opening in at least one side thereof, and said mounting base is provided with a pair of lip members which are inserted into said opening of said ornamental frame, one side edge of said fluorescent lamp being fitted between said lip members of said mounting base.

3. The indicating device as claimed in claim 1, wherein said ornamental frame is detachably fitted to said outer peripheral edges of said fluorescent lamp and has a socket at at least one end thereof, said fluorescent lamp having a plug at at least one end thereof which is receivable in said socket of said ornamental frame.

4. The indicating device as claimed in claim 1, wherein said ornamental frame and fluorescent lamp are rectangular, and said wire receiving groove extends both above and below said lamp and from one end of said lamp to the other for receiving electrical wires therein for energizing said lamp.

5. The indicating device as claimed in claim 1, comprising an indication means on both of said opposing flat side surfaces.

* * * * *